United States Patent [19]

Kanbar

[11] 4,298,200

[45] Nov. 3, 1981

[54] TANGRAM GAME ASSEMBLY

[76] Inventor: Maurice S. Kanbar, 4 E. 77th St., New York, N.Y. 10021

[21] Appl. No.: 151,836

[22] Filed: May 21, 1980

[51] Int. Cl.[3] ..... A63F 9/10

[52] U.S. Cl. ..... 273/157 R; 273/148 A

[58] Field of Search ..... 273/157 R, 148 A, 296, 273/1 G, 1 GE, 1 GF

[56] References Cited

U.S. PATENT DOCUMENTS 260,594 7/1882 Mehner ..... 273/157 R
4,114,877 9/1978 Goldfarb et al. ..... 273/1 GF

FOREIGN PATENT DOCUMENTS 1140117 11/1962 Fed. Rep. of Germany ... 273/157 R
641430 4/1928 France ..... 273/157 R
1123788 6/1956 France ..... 273/157 R

*Primary Examiner*—Anton O. Oechsle
*Attorney, Agent, or Firm*—Michael Ebert

[57] ABSTRACT

A Tangram game assembly constituted by two sets of Tangram pieces capable of creating a variety of geometric or representational figures. Also included is a deck of cards, each having printed thereon a Tangram puzzle figure and the solution thereto at a position at which it is obscured in play. In play, a card is withdrawn from the deck and its front face presented to the players who with their respective sets of pieces then race to recreate the figure. The player who is first to succeed is awarded the card. Cards in the deck are played, the player who gains the greatest number being the winner. Any number of cards may be played depending on how long the players would like the game to last.

8 Claims, 8 Drawing Figures

Fig. 1.
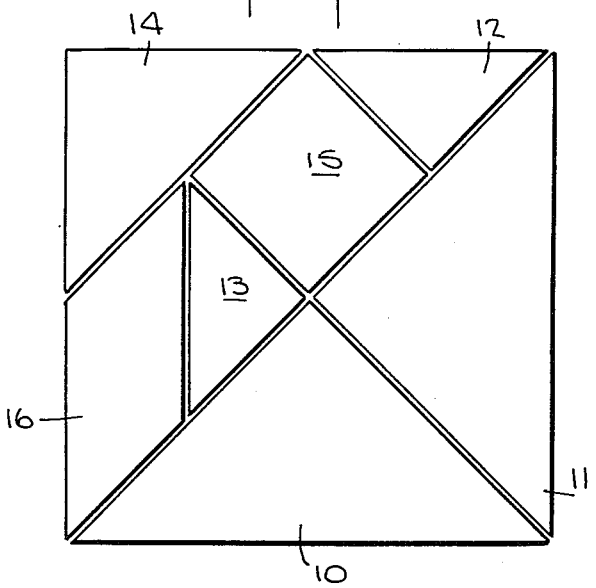
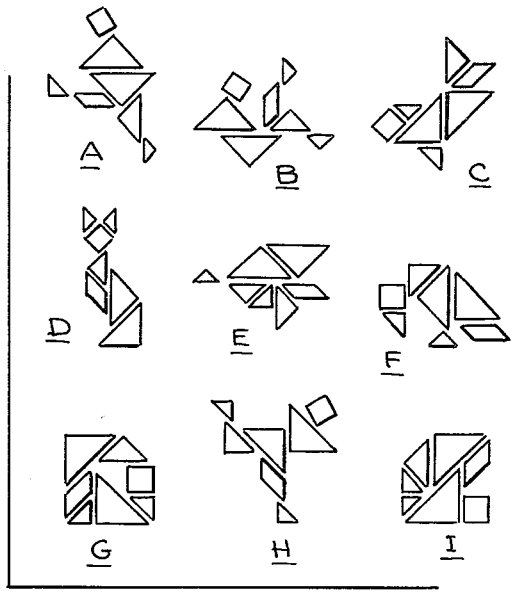
Fig. 2.
Fig. 3.
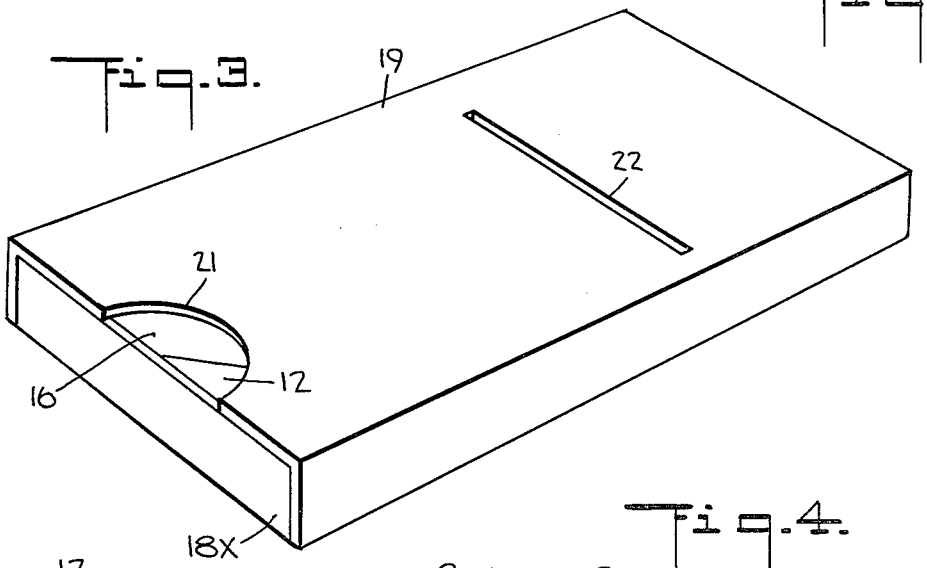
Fig. 4.
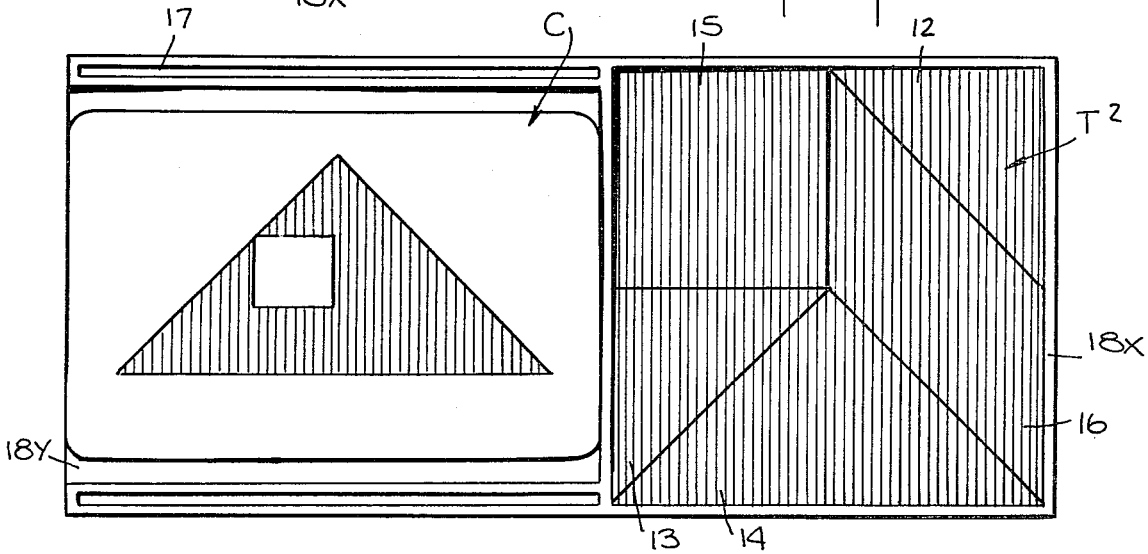

Fig. 7.
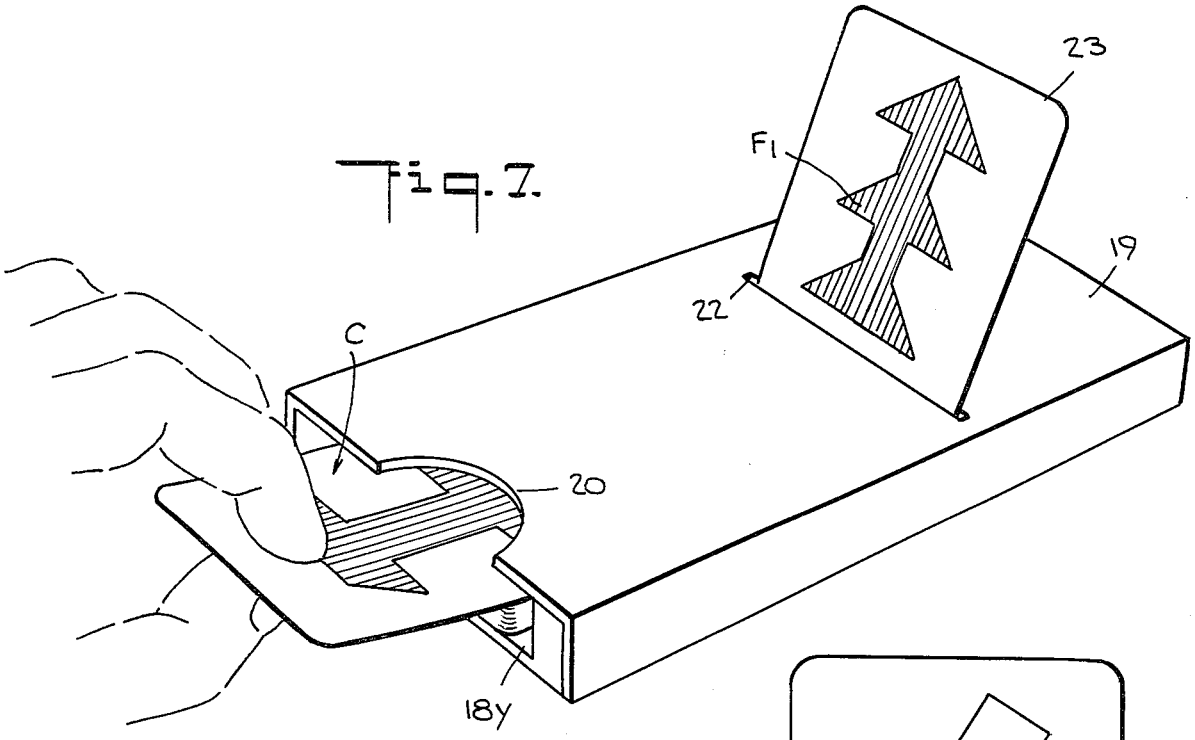
Fig. 5.
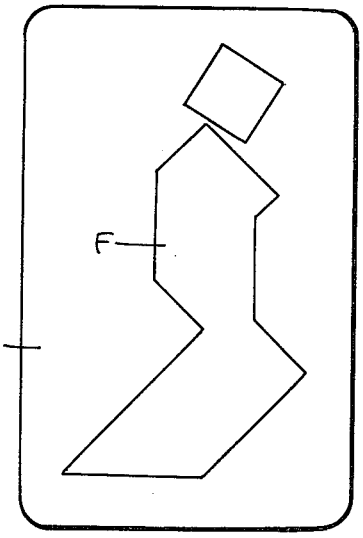
Fig. 8.
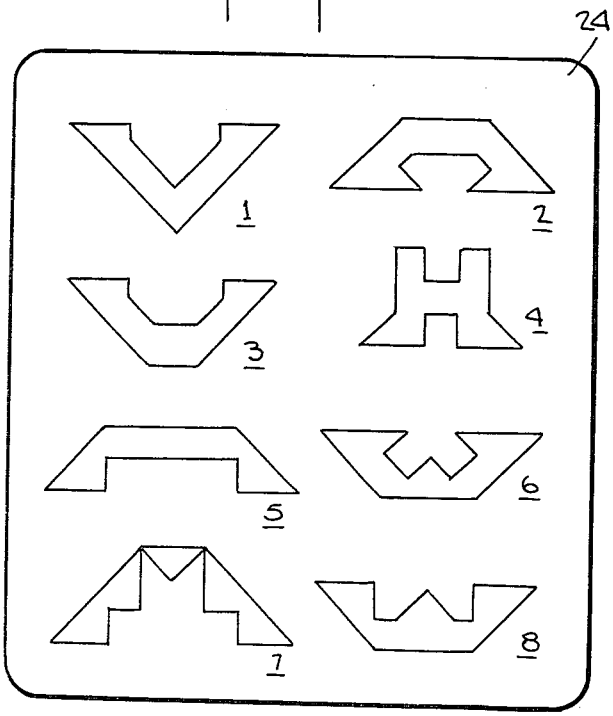
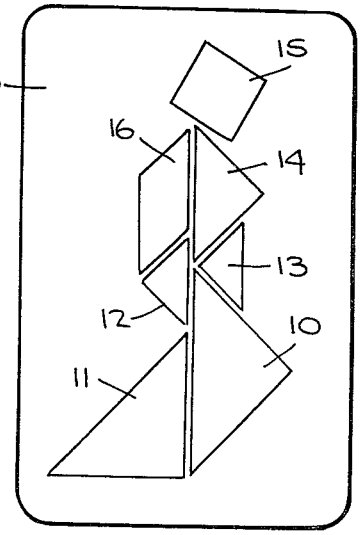
Fig. 6.

TANGRAM GAME ASSEMBLY

BACKGROUND OF INVENTION

This invention relates generally to Tangram puzzles, and more particularly to a Tangram game assembly adapted for competitive play, the assembly containing two complete sets of Tangram pieces and a deck of cards each carrying on its front face a Tangram puzzle figure and on its rear face the solution thereto.

Tangram is a puzzle game of ancient Chinese origin. To the extent that it is made up of interfitting pieces, it is comparable to a jigsaw puzzle. However, jigsaw pieces can be interfitted in only one way, whereas one may fit together Tangram pieces in many ways to create a great variety of shapes or patterns.

A Tangram consists of seven geometric pieces derived from a large square. A Tangram set is made up of two large triangles, two small triangles and a medium-sized triangle, plus a small square and a rhomboid. From these pieces the player is able to form figures that may be geometrical, abstract or representational in form. Thus the player can create human or animal silhouetted figures in various postures as well as silhouetted bridges, houses or other architectural configurations.

Currently available Tangram pieces are die cut or otherwise derived from a rigid, black plastic panel. In other cases, the plastic pieces may be injection molded. When these black pieces are fitted together, the junctions therebetween are not apparent. But if the pieces are placed on a white background and slightly separated, the junctions therebetween are rendered visible as thin white lines. A number of Tangram books have been published that contain hundreds of illustrations of different figure puzzles, any one of which can be created by fitting together the pieces of a single Tangram set.

Each figure in the book is illustrated without junction lines between the pieces, all pieces in the set being used. Hence the player has no way of knowing what arrangement of interfitting pieces will produce the illustrated figure other than the profile of the figure which affords a clue to this end. The player, after selecting a figure for play, then proceeds to fit the Tangram pieces together in an attempt to recreate the same figure. The book also contains an illustrated solution to each figure, the solution being the same figure but with the Tangram pieces slightly separated from each other to expose the junction lines therebetween so that the pieces are individually defined.

Thus what is presently being marketed is a package containing a set of Tangram pieces and a book illustrating different puzzle figures which can be formed from these pieces, the book also including solution figures. As now marketed, Tangram represents a puzzle which best lends itself to play by a solitary player. While it is possible for two players having their own sets to compete in recreating a Tangram figure, this game has limited play value, particularly since the game would have to be played by consulting a Tangram book.

The winner in this competitive game is the player who first solves the Tangram. But the choice of the Tangram figure to be played is discretionary and not dictated by the rules of the game. Hence players might disagree on the Tangram figure to be played or feel that whatever figure is chosen favors one player to the disadvantage of the other.

SUMMARY OF INVENTION

In view of the foregoing, the main object of this invention is to provide a Tangram game assembly for competitive play in which the choice of the figure to be played is a matter of chance and not, therefore, subject to dispute.

More particularly, an object of this invention is to provide an assembly of the above type which contains two complete sets of Tangram pieces and a deck of cards each carrying on its front face a Tangram puzzle, and on its rear face the solution thereto, the card selected for play being determined by its random position in the deck.

Yet another object of this invention is to provide an organized assembly of the above type in which both sets of Tangram pieces are housed within one compartment of a case whose other compartment accommodates the deck of cards.

A significant feature of the invention is that it does away with the need for a Tangram book, the cards containing the various figures serving a dual function; for each card not only carries an illustration of a Tangram figure and the solution thereto, but it also acts as a scoring device; for the player who is the first to solve the Tangram presented by a card is awarded that card whereby the player who accumulates the greatest number of cards from the deck is the winner.

Also an object of the invention is to provide an assembly of the above type in which each card contains several figures which are numbered, the players first throwing dice or otherwise gambling on the choice of figure to be played.

Yet another object of the invention is to provide a Tangram assembly which is compactly packaged and which may be mass-produced and marketed at low cost.

Briefly stated, these objects are accomplished in an assembly constituted by two sets of Tangram pices and a deck of cards, each card having on its front face a Tangram figure and on its rear face a solution thereto. Also included in the assembly is a rectangular case having a closed end and an open end, the case having a partition therein to define in conjunction with the closed end a compartment to receive two sets of Tangram pieces and to define in conjunction with the open end a compartment to accommodate the deck of cards.

A removable cover is provided which fits over the case, the cover having a closed end and an open end. In the storage mode, the cover is fitted over the case with its closed end overlying the open end, the cover thereby locking in the card deck. In the playing mode, the cover position is reversed to expose the end of the card deck to permit withdrawal of cards therefrom one at a time, the cover having a finger notch adjacent its open end to facilitate such withdrawal. The cover also includes a transverse slot acting as socket for the withdrawn card to present the card in an upright position to the players.

In the playing mode, a card is withdrawn from the deck and placed in the socket with its front face presented to the players who then race to fit together their Tangram pieces to recreate the front face figure. The player who first succeeds wins that card, a win being confirmed by the solution on the rear face. This activity is repeated with the cards in the deck whereby the player who is awarded the most cards is the winner of the game. In practice, not all cards in the deck are played, but only a selected number; for it takes about an hour for two players to play 5 cards.

OUTLINE OF DRAWINGS

For a better understanding of the invention as well as other objects and further features thereof, reference is made to the following detailed description to be read in conjunction with the accompanying drawings, wherein:

FIG. 1 illustrates the seven basic geometric pieces of a Tangram (four triangles, a square and a rhomboid);

FIG. 2 is an array of different geometric forms created from the seven pieces;

FIG. 3 is a Tangram players box in accordance with the invention, shown in its storage mode;

FIG. 4 shows the box with its cover removed;

FIG. 5 is the front face of one of the playing cards in the deck thereof;

FIG. 6 is the rear face of the same card;

FIG. 7 shows the box in its playing mode; and

FIG. 8 is a modified form of playing card.

DESCRIPTION OF INVENTION

Referring now to FIG. 1, there is shown a full set of Tangram pieces derived from a planar square. The set is composed of two large triangles 10 and 11, two small triangles 12 and 13, a medium-sized triangle 14, a small square 15 and a rhomboid 16.

As is well known, Tangram pices may be fitted together to create a wide range of different geometric or representational forms. In FIGS. 2A to 2I, nine geometric Tangram figures are illustrated with the pieces slightly spaced from each other. Hence one seeing these figures would know how to recreate the same forms, since the pieces are distinctly defined. These figures therefore represent Tangram solutions. A Tangram puzzle of, say, FIG. 2A would have the pieces in abutting relation, thereby erasing the junction lines, so that the player would have to exercise his visual imagination to recreate the same figure.

Referring now to FIGS. 3 and 4, there is shown a Tangram game assembly in accordance with the invention, the assembly comprising two sets of Tangram pieces $T^2$ and a deck of cards C, both the pieces and cards being housed in a common rectangular case 17. Case 17 has a closed end wall 18X, the other end 18Y thereof being open. Case 17 is divided by a partition 19 which in combination with the closed end defines a square compartment to receive the two sets of Tangram pieces $T^2$, and in combination with the open end to define a second compartment to accommodate the deck of cards C.

The two sets of Tangram pieces in the compartment are in a stack of four superposed layers, each layer being composed of pieces which form a small square whose area is one-half the full area of the large square shown in FIG. 1. Hence the height of the case must be equal to the height of the stack of pieces. Similarly, the number of cards in the deck is such as to produce a stack of substantially the same height as the stack of Tangram pieces.

Fitted snugly over case 17 is a removable cover 19, one end of which is closed and the other open. In FIG. 3, the case is shown in its storage mode with the open end of cover 19 aligned with the closed end 18 of the case. In this way, the closed end of the cover is aligned with the open end of the case to lock in the card compartment.

FIG. 5 shows the front face of one card 20 from card deck C, and FIG. 6 shows the rear face thereof. FIG. 5 carries a Tangram puzzle figure, while FIG. 6 shows the same figure with a slight separation between the pieces, so that this figure is the solution to the puzzle.

FIG. 7 shows the case in the playing mode in which the position of cover 19 is reversed with its open end aligned with the open end 18Y of the case to expose the deck of cards C. To facilitate withdrawal of cards one at a time, cover 19 is provided with a finger notch 21 at its open end. When a card is withdrawn, it is placed in an upright position in a socket formed by a transverse slot 22 in the cover. Thus card 23 socketed in slot 22 has its front face presented to the players with a Tangram figure puzzle $F_1$ shown. The rear face of this card has the solution to this puzzle.

In playing, the players who see the puzzle figure on the presented card then simultaneously proceed with their sets of pieces to recreate the figure as quickly as they can. The first to succeed, as confirmed by the solution on the rear face, is awarded the card. This activity is repeated with each withdrawn card. The player who is awarded the greatest number of cards is the winner.

In practice, one does not usually play the entire deck, for this would take too long. Hence only a predetermined number of cards is played, say, 5 or 10 cards. Thus 5 cards would normally take two players about an hour to play.

To further complicate the game and enhance its play value, each card in the deck, such as card 24 in FIG. 8, may contain a group of different Tangram figures on its front face, such as the figures identified by numerals 1 to 8, the rear face containing solutions thereto. Then by rolling dice, rotating a pointer on a radially-numbered dial, or by other chance devices adapted to select a number, a choice of numbered figure is made. This chance action is alternated from player to player, so that each gets a turn at the dice. To win a multiple-figure card, the player who succeeds with the greatest number of figures on the card is awarded the card.

While there has been shown and described a preferred embodiment of a Tangram game assembly in accordance with the invention, it will be appreciated that many changes and modifications may be made therein without, however, departing from the essential spirit thereof. Thus rather than have each card with a puzzle figure on one face and a solution figure on the opposite face, the same puzzle figure may be printed on both faces of the card so that the players may face each other with the box supporting the card being played at an intermediate position between the two players. In this instance, the solution figures will appear in a small scale on the lower edge of the card on either face thereof, the solution figure being obscured when the card is inserted in the socket of the box to assume an upright position.

I claim:

1. A Tangram puzzle game assembly comprising:

A two sets of Tangram pieces each derived from a large square;

B a deck of cards each having printed thereon a Tangram puzzle figure and a solution thereto; and C a box including a case divided into two compartments, the first housing said two sets of pieces and the second housing said cards, said box including means to support a selected card in an upright position at which it can be observed by players.

2. An assembly as set forth in claim 1, wherein said first compartment has a square area equal to one half said large area whereby said pieces are stacked therein in four layers.

3. An assembly as set forth in claim 1, wherein said case has an open end and a closed end, the open end exposing the deck in said second compartment, said box further including a cover fitting over the case and having a closed end and an open end, the cover in the storage mode having its open end aligned with the closed end of the case, and in the playing mode having its open end aligned with the open end of the case to permit withdrawal of the cards.

4. An assembly as set forth in claim 3, wherein said cover includes a finger notch adjacent the open end.

5. An assembly as set forth in claim 3, wherein said cover includes a transverse slot to form a socket for holding a withdrawn card in an upright position.

6. An assembly as set forth in claim 1, wherein each card has a Tangram puzzle figure on one face and a solution figure therefor on the opposite face.

7. An assembly as set forth in claim 1, wherein said cards each have multiple figures which are selectable by the players.

8. An assembly as set forth in claim 1, wherein each card has on either face thereof the same Tangram puzzle figure, and on its lower edge a small scale solution figure.

* * * * *